US005084917A

United States Patent [19]

Matsubara et al.

[11] Patent Number: 5,084,917

[45] Date of Patent: Feb. 4, 1992

[54] LAVATORY SEAT DEVICE

[75] Inventors: Osamu Matsubara, Anjo; Kenichi Kaneko, Kariya; Shinji Kawai, Toyota, all of Japan

[73] Assignee: Aisin Seiki Kabushiki Kaisha, Kariya, Japan

[21] Appl. No.: 617,794

[22] Filed: Nov. 26, 1990

[30] Foreign Application Priority Data

Nov. 28, 1989 [JP] Japan ..... 1-137401[U]
Nov. 30, 1989 [JP] Japan ..... 1-139198[U]
Nov. 30, 1989 [JP] Japan ..... 1-139199[U]

[51] Int. Cl.[5] ..... A47K 13/00
[52] U.S. Cl. ..... 4/237; 4/DIG. 6; 219/217
[58] Field of Search ..... 4/234, 237, DIG. 6; 219/217

[56] References Cited

U.S. PATENT DOCUMENTS 4,446,584 5/1984 Suzuki et al. ..... 4/237

FOREIGN PATENT DOCUMENTS 48305 5/1983 Fed. Rep. of Germany ... 4/DIG. 6
0295933 11/1989 Japan ..... 4/DIG. 6

*Primary Examiner*—Charles E. Phillips
*Attorney, Agent, or Firm*—Oblon, Spivak, McClelland, Maier & Neustadt

[57] ABSTRACT

A lavatory seat device includes lavatory seat accommodating a heater and a thermo-sensor for detecting a temperature thereof. First lead wires supply an electric current to the heater. Second lead wires convey a signal from the thermo-sensor. A control circuit controls the heater in response to the thermo-sensor in such a manner that the current supply of the heater is interrupted when the signal from the thermo-sensor becomes a set value or the cutting of the second lead wires is detected. A case has the control circuit therein. A first pivot portion of the lavatory seat has a hole through which the first and second lead wires extend. A second pivot portion of the case is fitting with the first pivot portion to pivot the lavatory seat. A holder holds the first and second lead wires in such a manner that the cutting of the first lead cannot occur prior to the cutting of the second lead wire.

6 Claims, 5 Drawing Sheets

LAVATORY SEAT DEVICE

BACKGROUND OF THE INVENTION

1. Field of the Invention

This invention relates to a lavatory seat device, and more particularly to a lavatory seat device having an internal heater, thermo-sensor and the like.

2. Description of the Related Art

In general, a lavatory seat device may include in a lavatory seat, a heater having a thermo-sensor, lead wires for connecting the heater and the thermo-sensor with a control circuit, a case having the control circuit therein, a first pivot portion mounted on the lavatory seat and forming a hole through which the lead wires pass, and a second pivot portion mounted on the case and fitted with the first pivot portion for rotatably supporting the lavatory seat.

The lavatory seat may be warmed up by the heater inserted therein, and the temperature of the seat is detected by the thermo-sensor and controlled to a desired level.

If the lavatory seat should be warped due to manufacturing errors, the first and second pivot portions would be broken by sitting on the lavatory seat, and that causes the lead wires to be broken or cut. In such a case, current is unnecessarily supplied to the heater due to the fact that the thermo-sensor can not detect the overheating of the seat.

SUMMARY OF THE INVENTION

It is an object of the invention to provide an improved lavatory seat device which obviates the above conventional drawbacks.

It is another object of the invention to provide an improved lavatory seat device including a lead wire connected with a thermo-sensor, which can be more easily cut than a lead wire connected with a heater.

In order to attain the foregoing objects, a lavatory seat device includes a lavatory seat accommodating a heater and a thermo-sensor for detecting a temperature thereof. First lead wire means supply an electric current to the heater, and second lead wire means detect a signal from the thermo-sensor. A control circuit controls the heater in response to the thermo-sensor in such a manner that the current supply of the heater is interrupted when the signal from the thermo-sensor becomes a set value or the cutting of the second lead wire is detected. A case has the control circuit means therein. A first pivot portion of the lavatory seat forms a hole through which the first and second lead wires extend. A second pivot portion of the case fits with the first pivot portion to pivot the lavatory seat. Holding means hold the first and second lead wire means in such a manner that the cutting of the first lead means can not occur prior to the cutting of the second wire means.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DESCRIPTION OF THE PREFERRED EMBODIMENTS

Figure 1:
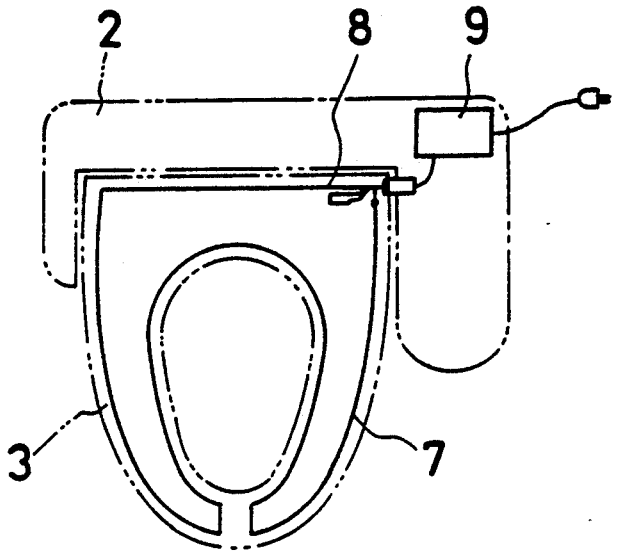
FIG. 1 is a plan view showing a lavatory seat device of the present invention.

Referring to FIG. 1, there is illustrated a lavatory seat device which includes a lavatory seat 3 and a case 2 behind the lavatory seat 3. The case 2 rotatably holds a rear end portion of the lavatory seat 3 relative to a toilet bowl. The case 2 is formed C-shaped, as shown in FIG. 1. The lavatory seat 3 has a heater 7 and a thermo-sensor 8 therein.

Figure 2:
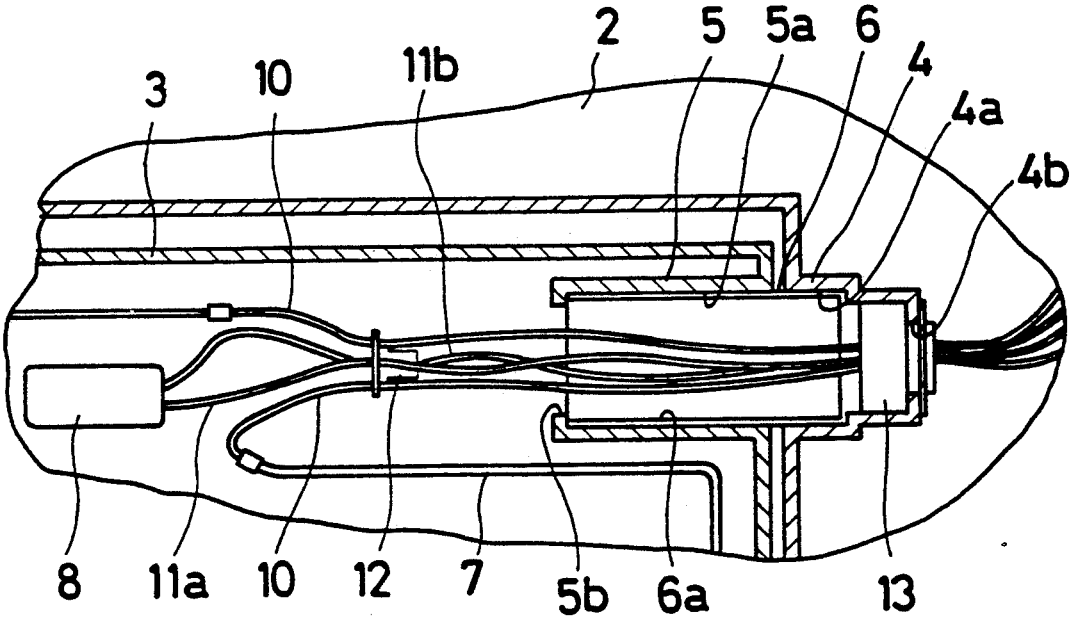
FIG. 2 is an elevation view showing a connecting portion of lead wires of a first preferred embodiment according to this invention.

Referring to FIG. 2 showing a first preferred embodiment of the present invention, a pair of cylindrical pivot portions 4 are formed on the case 2 (only one is shown in FIG. 2) so as to extend within the case 2 to define a pair of penetrating holes 4*a*. A pair of cylindrical pivot portions 5 are formed at the rear end portion of the lavatory seat 3 (only one is shown in FIG. 2) so as to extend within the lavatory seat 3 and define a pair of penetrating holes 5*a*. The penetrating holes 4*a* in the pivot portion 4 and the penetrating holes 5*a* in the pivot portion 5 are aligned so that a common pivot pin 6 can be mounted therein, such that the lavatory seat 3 can be rotated thereabout. The pivot portions 4 and the pivot portions 5 are defined as a first pivot portion and a second pivot portion, respectively.

A heater 7 which warms a surface of the lavatory seat 3 and a thermo-sensor 8 which detects a temperature of the lavatory seat are installed within an inner space of the lavatory seat 3. A control circuit 9 is provided in the case 2 and controls an electric current to the heater based on a signal from the thermo-sensor 8 to keep a temperature of the lavatory seat 3 at a desired value. The heater 8 and the thermo-sensor 9 are connected to the control circuit means 9 by the lead wires 10, 11*a*, 11*b*, respectively.

The pivot pin 6 has a cylindrical pipe passage 6*a* which cylindrically extends from the second pivot portion 5 to the first pivot portion 4 and is designed to pass the lead wires 10, 11*a*, 11*b* therethrough.

The lead wires 10 connected with the heater 7 and the lead wires 11*a*, 11*b* connected with the thermo-sensor 8 are held by a holding member 12 fixed within the lavatory seat 3 and a holding member 13 fixed in the case 2.

Figure 3:
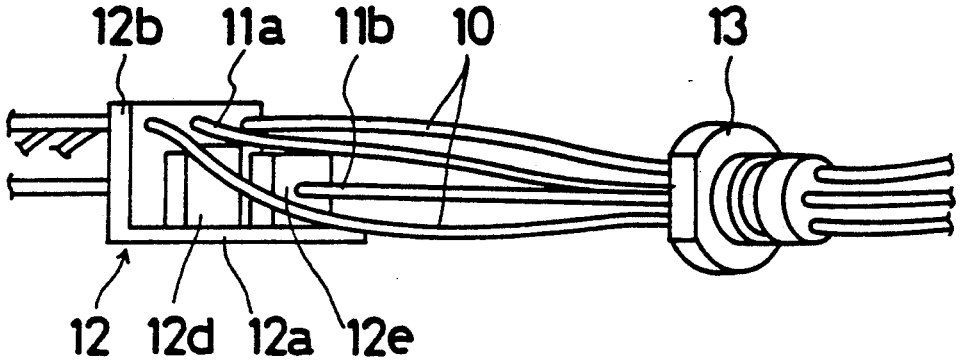
FIG. 3 is a schematic plan view showing the connecting portion of FIG. 2.
Figure 4:
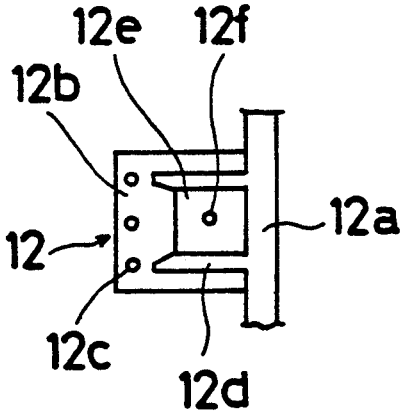
FIG. 4 is a view illustrating the holding member shown FIG. 2.

As shown in FIGS. 3 and 4, a base 12*a* of the holding member 12 has a holder 12*b* holding the two lead wires 10 and a lead wire 11*a* via the holes 12*c* (FIG. 4). A nail portion 12*d* is formed on the base 12*a* and retains a holder 12*e* which holds the other lead wire 11*b* connected with the thermo-sensor 8 via a tube 12*f* (FIG. 4). The thickness of the holder 12*e* is greater than that of the holder 12*b* in the axial direction of the lead wires.

Thus, a surface area of the other lead wire 11*b* held by the holder 12*e* is larger than the surface areas of each of the lead wires 10 and the lead wire 11*a* held by the holder 12*b*. This causes a greater frictional resistance to movement for lead wire 11*b* as compared to the other lead wires, i.e., the frictional resistance of the lead wire 11*b* is larger than that of the lead wires 10 and 11*a*. When a tensile force acts on the lead wires 10, 11*a* and 11*b* due to the breakage of the pivot portions 4, 5 or the pivot pin 6 upon a user sitting on the lavatory seat 3, the lead wires 10 and 11*a* can absorb the tensile force by easily sliding. However, the other lead wire 11*b* cannot as easily absorb the tensile force because of the larger frictional area between the lead wire 11*b* and the holder 12. The lead wire 11*b* is thus pulled more strongly and will be cut earlier than the other lead wires 10 and 11*a*.

As mentioned above, according to the present invention, if any one of the pivot pin 6 and the pivot portions 4, 5 is broken, the lead wire 11*b* connected with the thermo-sensor is cut before one of the lead wires 10 which connect a power supply and the heater.

Figure 9:
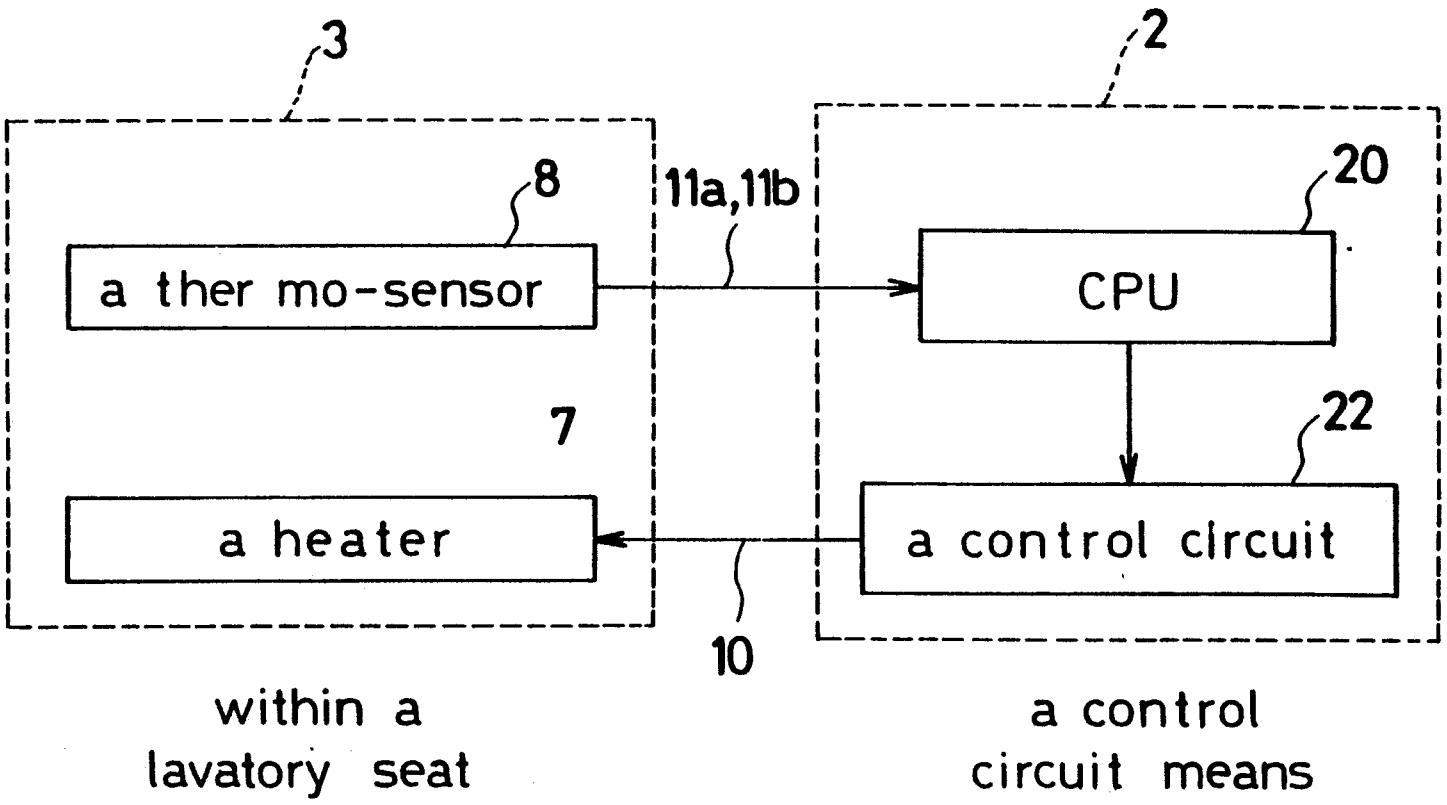
FIG. 9 is a block diagram showing a control device for the electrically controlling the heater.

In operation, referring to FIG. 9, the thermo-sensor 8 provides a signal to CPU 20. The CPU 20 discriminates the signal and provides a signal to the control circuit 22 for the heater 7.

Figure 10:
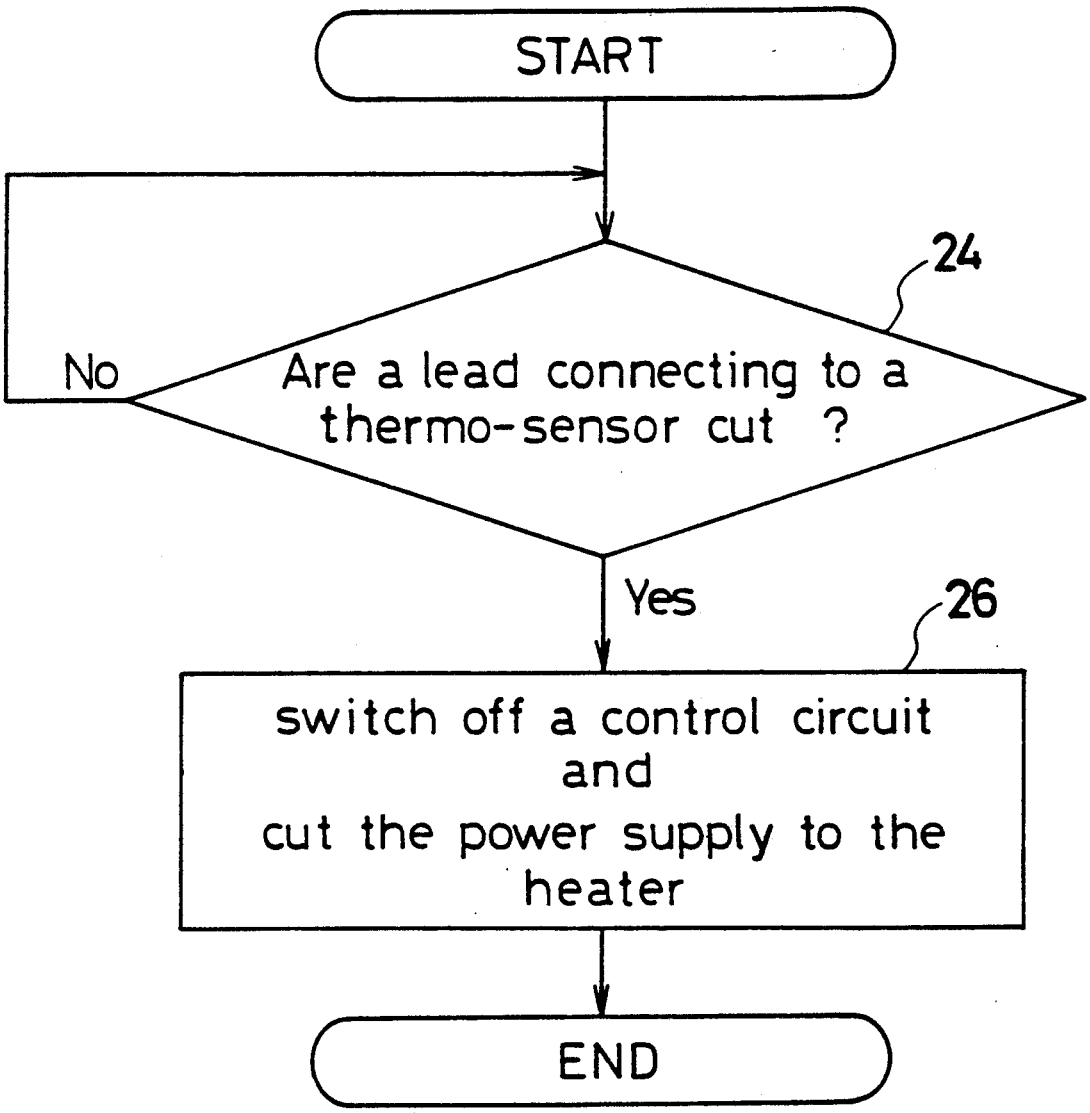
FIG. 10 is a flow chart of a controlling program for use in the control circuit of the present invention.

FIG. 10 is a flow chart for a controlling program used for the control of the heater 7. At step 24, the CPU 20 receives the signal provided from the thermo-sensor 8 and discriminates whether one of the lead wires 11*a*, 11*b* connecting to the thermo-sensor 8 are cut. In the case of yes, at step 26, the CPU 20 provides a signal to the control circuit 22 and cuts the power supply to the heater 7. As above described, the supply of the power source is thus certainly stopped before the contacting resistances of the lead wires 10 are increased.

Figure 5:
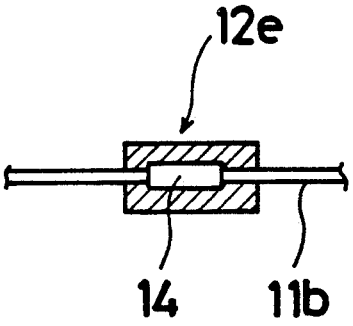
FIG. 5 is a plan view showing a second embodiment of an hold means of FIG. 2 or 3.

Referring to FIG. 5 showing a second preferred embodiment of the present invention, the lead wire 11*b* is fixed to a terminal 14 in the holder 12*e*. The lead wire 11*b* and the terminal 14 are formed integrally within the holder 12*e*, so that the frictional resistance between the lead wire 11*b* and the holding member 12 is increased.

Figure 6:
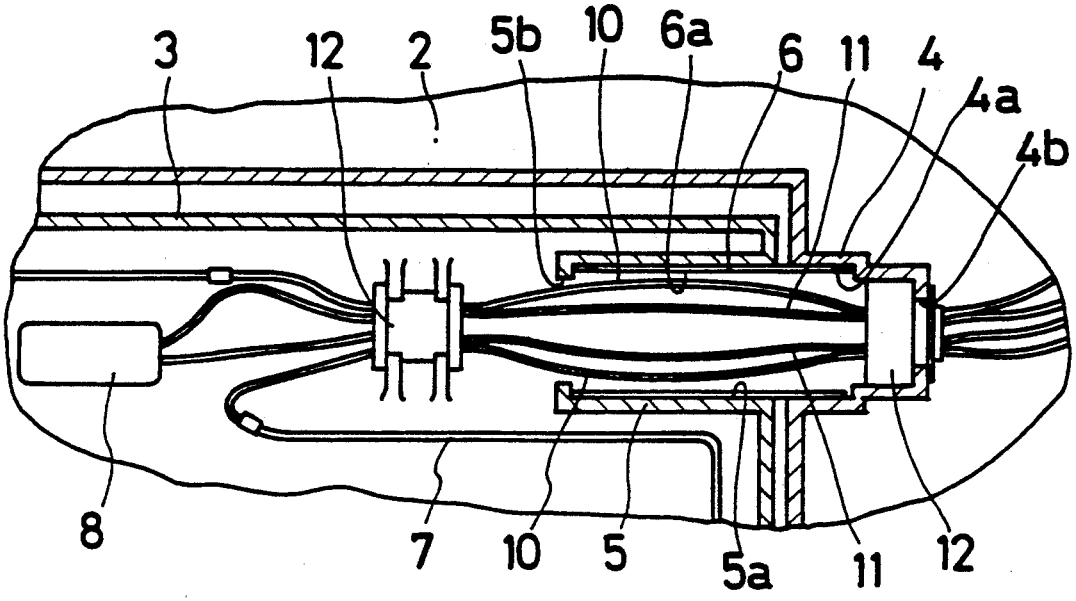
FIG. 6 is an elevation view showing a connecting portion of the lead wires of a third preferred embodiment according to this invention.

FIG. 6 shows the third preferred embodiment according to this invention. The lead wires 10 connected with the heater 7 and the lead wires 11 connected with the thermo-sensor 8 are held by a pair of holding members 12, and the length of lead wires 10 between the holding members is longer than that of the lead wires 11 between the holding members.

In the above mentioned device, if any one of the pivot pin 6 and the pivot portions 4, 5 is broken, the lead wires 11 connected with the thermo-sensor 8 are cut before the lead wires 10 which are connected to power supply for the heater 7 are cut because the lead wires 10 are longer than the lead wires 11.

In addition, when the lead wires 10 and 11 are wrenched or twisted due to the opening of the lavatory seat, the torsional amount of the lead wires 10 is smaller than that of the lead wires 11 because the lead wires 10 are longer than the lead wires 11. Thus, the wires 10 can be more durable.

Figure 7:
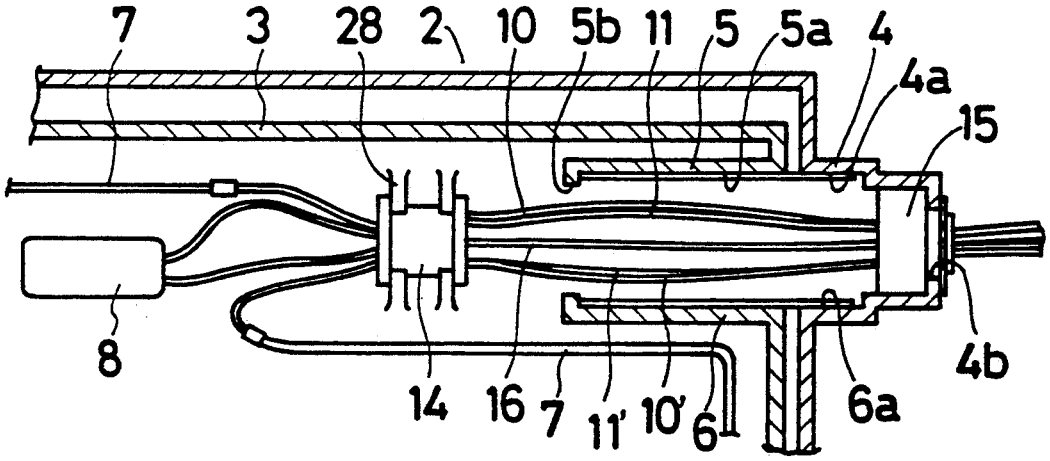
FIG. 7 is an elevation view showing a connecting portion of the lead wires of a fourth preferred embodiment according to this invention.
Figure 8:
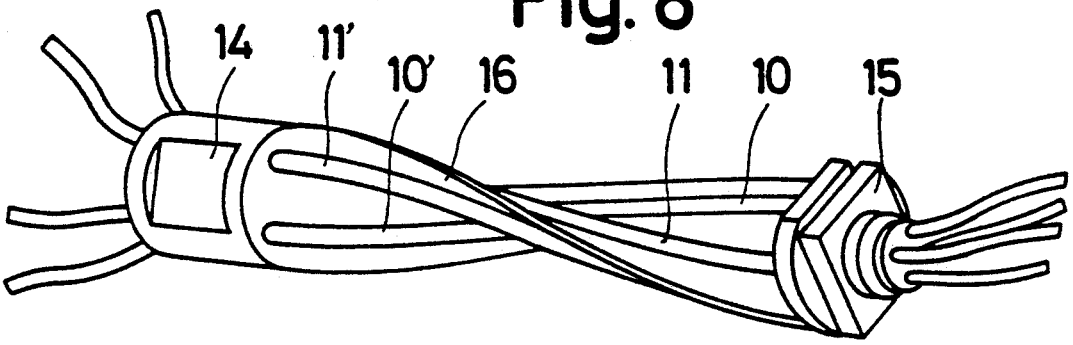
FIG. 8 is a view illustrated a plastic plate with the lead wires according to FIG. 7.

FIG. 7 shows a fourth preferred embodiment according to this invention. The lavatory seat device has a similar structure to the lavatory seat device shown in FIG. 6 excepting that the fourth embodiment has a plastic plate 16. The lead wires 10, 10′ are connected with the heater 7 and the lead wires 11, 11′ are connected with the thermo-sensor 8. The lead wires 10, 10′, 11, and 11′ are held by a pair of holding members 14 and 15. The holding member 14 is supported by a holder 28 which is fixedly connected to the lavatory seat 3 and the holding member 15 is fixedly inserted in the pivot portion 4 of the case 2. The length of the lead wires 10, 10′ between the holding members 14, 15 is longer than that of the holding member 14 and the holding member 15 are connected integrally by the plastic plate 16 which is deformable as clearly viewed from FIG. 8. The plastic plate 16 separates the lead wire 10 and the lead wire 11 from the lead wire 10′ and the lead wire 11′.

In the device as described above, if any one of the pivot pin 6 and the pivot portions 4, 5 is broken, the lead wires 11 connected with the thermo-sensor 8 is cut before the lead wires 10 which connect an electric source with the heater 7 are cut, because the lead wires 10 are longer than the lead wires 11. In case that the lead wire 11 is cut, the lead wire 11′ is not contacted with the lead wire 11 because the plastic plate 16 is designed to separate the lead wires 10, 10′ and the lead wires 11, 11′. Thus, the supply of the power source to the heater 7 is certainly stopped before the resistance of the lead wires 10 is increased.

In addition, the holding members 14 and 15 are integrally formed with the plastic plate 16 and have a good rigidity. Upon assembling the lead wires and holding members, the holding member 15 is put into the pivot portion 4 after the lead wires 10, 10′, 11, and 11′ are connecting to the holding members 14, 15 and the plastic plate 16. Thus, the lead wires can be easily accommodated via the inlet 5*b*, the penetrating pin 6 and the outlet 4*b*, so that assembling of the lavatory seat device becomes easier.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A lavatory seat device comprising:

a lavatory seat including an opening to communicate with a toilet bow, said lavatory seat accommodating a heater and a thermo-sensor therein, said sensor for detecting a temperature of the heater;

first and second lead wire means;

control circuit means responsive to the signal from said thermo-sensor for controlling said heater in such a manner that the current supply to said heater is interrupted when said signal from said thermo-sensor reaches a set value or when cutting of said second lead wire means is detected;

a case having said control circuit means therein;

said first lead wire means for supplying an electric current from said control circuit to said heater;

said second lead wire means for conveying a signal from said thermo-sensor to said control circuit means;

a first pivot portion on said lavatory seat having a hole through which said first and second lead wire means extend;

a second pivot portion on said case fitting with said first pivot portion to allow pivoting of said lavatory seat relative to said case; and holding means for holding said first and second lead wire means in such a manner that upon breakage of said first pivot portion or said second pivot portion, thus allowing, increased tensile force on said first and second lead wire means, said first lead wire means will not be cut by said increased tensile force prior to said second wire means being cut.

2. A lavatory seat device according to claim 1, wherein said first and second lead wire means each comprise two wires and wherein said second lead wire means is held by said holding means with a larger surface area than is said first lead wire means.

3. A lavatory seat device according to claim 2, wherein said holding means includes a holding member comprising:

a first holder holding at least one of said second lead wire means with a predetermined surface area; and a second holder holding said first lead wire means with a surface area smaller than said predetermined surface area.

4. A lavatory seat device according to claim 1, wherein said holding means includes two spaced holding members, and wherein a length of said first lead wire means between said holding members is longer than that of said second lead wire means therebetween.

5. A lavatory seat device according to claim 4, further including:

a plate connecting said holding members and dividing one wire of said first lead wire means and one wire of said second lead wire means from another wire of said first lead wire means and another wire of said second lead wire means.

6. A lavatory seat device according to claim 5, in which said plate is made of a deformable plastic.

* * * * *